US008181458B2

(12) United States Patent
Roeber

(10) Patent No.: US 8,181,458 B2
(45) Date of Patent: May 22, 2012

(54) PRESSURE RECOVERY SYSTEM

(75) Inventor: Thomas W. Roeber, Yarmouth, ME (US)

(73) Assignee: Parker-Hannifin Corporation, Cleveland, OH (US)

( * ) Notice: Subject to any disclaimer, the term of this patent is extended or adjusted under 35 U.S.C. 154(b) by 903 days.

(21) Appl. No.: 12/240,189

(22) Filed: Sep. 29, 2008

(65) Prior Publication Data

US 2009/0084104 A1 Apr. 2, 2009

Related U.S. Application Data

(60) Provisional application No. 60/975,825, filed on Sep. 28, 2007.

(51) Int. Cl.
*F16D 31/02* (2006.01)

(52) U.S. Cl. ..... 60/419; 60/489

(58) Field of Classification Search ..... 60/419, 60/462, 488, 489

See application file for complete search history.

(56) References Cited

U.S. PATENT DOCUMENTS

| | | | | |
|---|---|---|---|---|
| 3,253,410 | A | 5/1966 | Albers | |
| 4,470,259 | A | 9/1984 | Miller et al. | |
| 4,723,475 | A | 2/1988 | Burk | |
| 5,251,442 | A | 10/1993 | Roche | |
| 5,293,745 | A | 3/1994 | Roche | |
| 5,319,932 | A | 6/1994 | Roche | |
| 6,116,138 | A | 9/2000 | Achten | |
| 6,279,317 | B1 | 8/2001 | Morgan | |
| 6,438,951 | B2 | 8/2002 | Morgan | |
| 6,575,076 | B1 | 6/2003 | Achten | |
| 6,922,992 | B1 | 8/2005 | Morgan | |
| 6,931,846 | B1 | 8/2005 | Trinkel, Jr. | |
| 7,000,386 | B1 | 2/2006 | Morgan | |
| 7,775,040 | B2 * | 8/2010 | Khalil | 60/419 |

FOREIGN PATENT DOCUMENTS

EP 0 882 181 12/1998

* cited by examiner

*Primary Examiner* — Michael Leslie

(74) *Attorney, Agent, or Firm* — Renner, Otto, Boisselle & Sklar, LLP

(57) ABSTRACT

A pressure recovery system according to the present invention comprises a pump, a flow control valve and a flow amplifier. The flow control valve has an inlet connected to the outlet of the pump, an outlet for supplying fluid to the load to which pressurized fluid is to be supplied, and a bypass flow outlet connected to the flow amplifier. The bypass flow drives the flow amplifier for supplying fluid to an inlet of the pump.

12 Claims, 4 Drawing Sheets

PRESSURE RECOVERY SYSTEM

PRIORITY

This application claims priority of U.S. Provisional Application No. 60/975,825 filed Sep. 28, 2007, which is hereby incorporated herein by reference.

FIELD OF THE INVENTION

The invention herein described relates generally to systems for supplying hydraulic fluid to a load and more particularly to such systems wherein the supply pump is driven by a variable speed prime mover, such as a vehicle engine that varies in speed for reasons unrelated to the fluid flow requirements of the load.

BACKGROUND

In some lubrication applications, it is difficult to get a mechanically driven pump in a remote location of a gearbox, transmission, etc. As a result, the designer has to resort to a hydraulically driven pump or an electrically driven pump. A hydraulically driven pump (i.e. a pump driven by a hydraulic motor) may be the most desirable for reliability if a source of high pressure flow is available to drive the hydraulic motor.

In many cases and as illustrated in FIG. 1, a remotely driven pump assembly 20 includes a hydraulic motor 22 (e.g. a spur gear, internal crescent gear, gerotor, or piston motor) which drives a shaft 24 to drive a low pressure pump 26 (e.g. a gear, gerotor, or piston pump). The pump draws fluid from the sump 26 for supply by the pump to the load, or for a scavenge pump to pull fluid from a sump to return to another tank, for example.

The foregoing system requires a source of relatively constant high pressure for desired operation of the pump assembly 20. In many cases, the prime mover that drives the supply pressure pump varies in speed, as in the case of a vehicle where the pump is driven off the vehicle engine and thus has a rotational speed that increases and decreases along with the engine speed. This situation is typical of automobile engine oil pumps and automatic transmission oil pumps. In these cases the pump size typically is based on the worst case, that typically being high engine idle. Consequently, in many cases the pump will start to cavitate well under the maximum speed of the engine (or other prime mover). The cavitation generates noise that can be annoying to the occupant or occupants of the vehicle or someone in the vicinity of the pump.

The simplest solution to this problem is simply to live with the noise. Others have tried jet pumps, but this approach is very inefficient.

SUMMARY OF THE INVENTION

The present invention provides an energy efficient system that can be used in applications where the pump prime mover varies in speed, and the pump produces more flow at higher speeds than the load requires. As above noted, this situation is typical of automobile engine oil pumps and automatic transmission oil pumps. Systems according to the present invention, however, are applicable to other applications as well. In essence, the present invention provides a self-actuated charge pump for supplying fluid to a pump, the charge pump being in the form of a flow amplifier that is actuated by bypass flow from a flow control valve.

A pressure recovery system according to the present invention comprises a pump, a flow control valve and a flow amplifier. The flow control valve has an inlet connected to the outlet of the pump, an outlet for supplying fluid to the load to which pressurized fluid is to be supplied, and a bypass flow outlet connected to the flow amplifier. The bypass flow drives the flow amplifier for supplying fluid to an inlet of the pump.

In a preferred embodiment, the flow amplifier when actuated receives fluid from a sump, combines the fluid from the sump with fluid used to actuate the flow amplifier, and provides the fluid to the pump that preferably is connected to the sump through a check valve.

The flow amplifier may be one of a gerotor pump, a vane pump, an axial piston pump, and a spur gear pump. When the flow amplifier is a dual port gerotor pump, fluid directed to the flow amplifier from the control valve may drive the gerotor, the gerotor when driven drawing fluid from a sump and providing fluid to the pump.

Typically, the pump will be capable of supplying flows substantially higher than the maximum flow rate required by the load. In such a situation, the system can have several operating ranges. At low speed, when pump flow is less than the load's maximum flow rate, the flow control valve normally will not be activated and all flow from the pump is directed to the load. As a result, there is no bypass flow and the flow amplifier is not activated. The pump pulls all of its flow directly from the sump, through the check valve.

At mid-range, when pump flow is greater than the load's maximum flow rate but the pump has not reached its cavitation speed yet, the flow control valve typically will be activated so that only the required flow is directed to the load. The remainder of the flow is bypass flow that is directed to the flow amplifier. The flow amplifier then provides some make-up flow to the pump inlet, but the pressure in the makeup circuit will be minimal since it will match the flow from the sump through the check valve.

At high speed or range, when the flow amplifier is creating more flow than the pump, and the flow amplifier starts to pressurize the pump inlet, the check valve on the primary pump line is closed and the pressure on the pump inlet can be raised above atmospheric pressure, increasing the speed at which the pump can be operated without cavitating.

The flow amplifier preferably is of a positive displacement type such as a gerotor or vane pump with a split inlet port, a three or more spur gear system, or a piston pump.

In an embodiment using a gerotor or vane pump as the flow amplifier, advantage is taken of the fact that the individual pumping chambers are sealed from each other during the full 360 degrees of rotation. This allows the use of split porting for the inlet of the device. One inlet receives high pressure bypass flow from the control valve for causing the gearset to rotate while the second inlet is connected to the system sump.

Further features of the invention will become apparent from the following detailed description when considered in conjunction with the drawings.

BRIEF DESCRIPTION OF THE DRAWINGS

In the annexed drawings.

DETAILED DESCRIPTION

Figure 1:
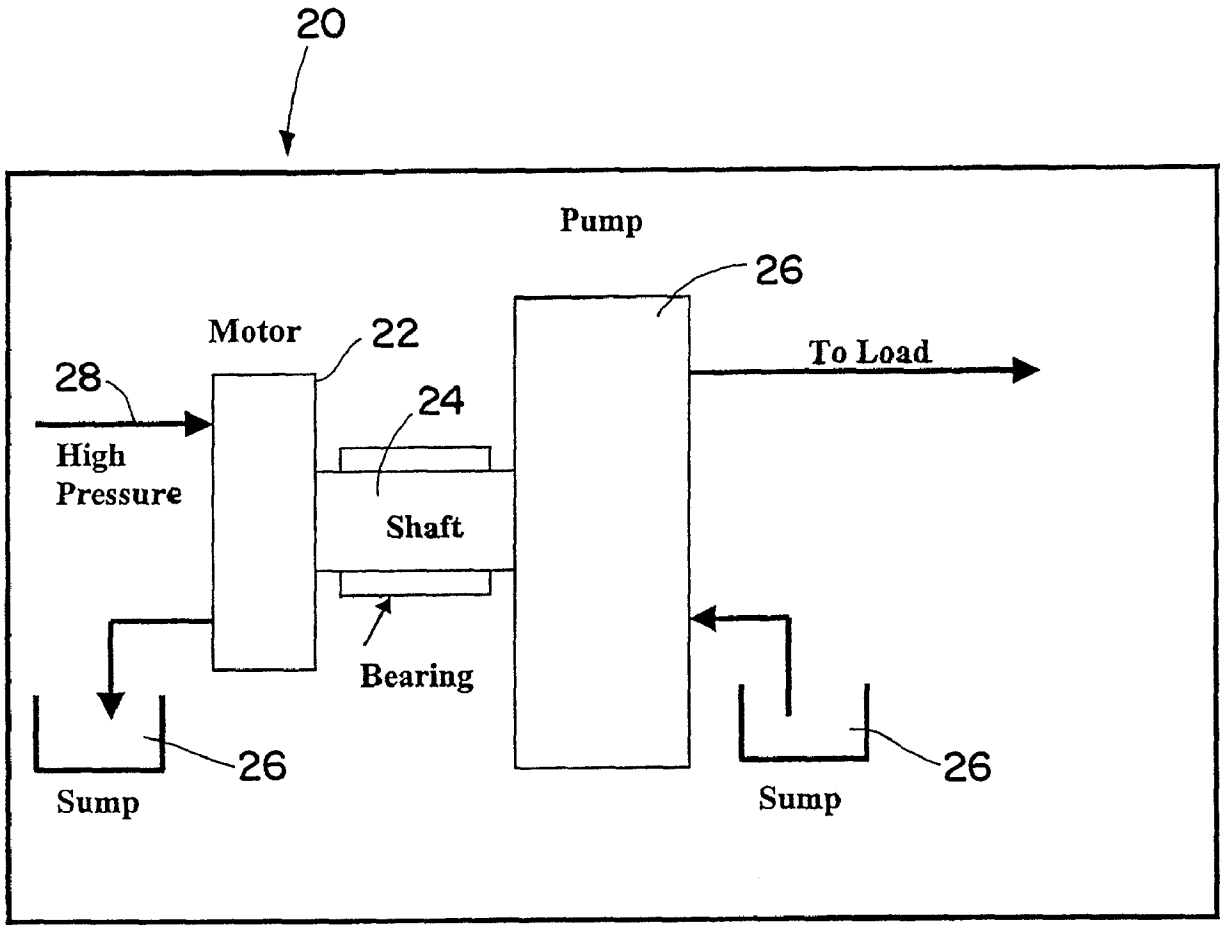
FIG. 1 Prior Art
FIG. 1 is a schematic illustration of a prior art hydraulic circuit for providing pressurized fluid to a load, such as for lubrication.
Figure 2:
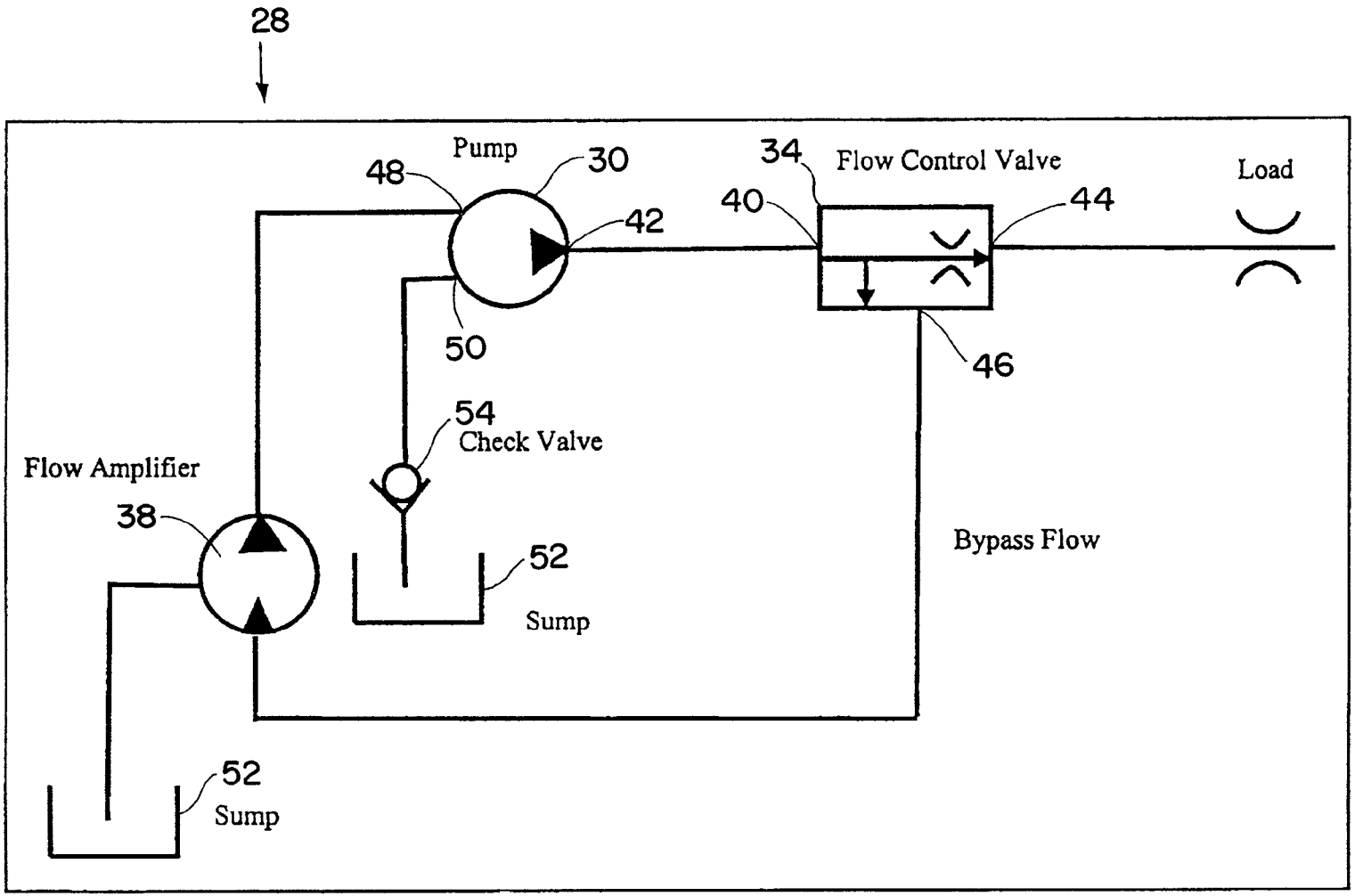
FIG. 2 is a schematic illustration of an exemplary hydraulic circuit in accordance with the invention.

Referring now in detail to the drawings and initially to FIG. 2, an exemplary pressure recovery system 28 according to the present invention includes a pump 30, a flow control valve 34 and a flow amplifier 38. The system 28 is useful in applications where the prime mover (not shown) of pump 30 varies in speed, and the pump 30 produces more flow at higher speeds than the load requires. This situation is typical of automobile engine oil pumps and automatic transmission oil pumps, for example.

The pump 30 can be driven by any suitable means, typically by an engine or variable speed prime mover, and supplies fluid to the flow control valve 34. The flow control valve 34 has an inlet 40 connected to an outlet 42 of the pump 30, an outlet 44 for supplying fluid to the load to which pressurized fluid is to be supplied, and a bypass flow outlet 46 connected to the flow amplifier 38. As will be described in more detail below, under certain condition the bypass flow drives the flow amplifier 38 for supplying fluid to an inlet 48 of the pump 30.

In the illustrated embodiment, the flow amplifier 38 when actuated by the bypass flow receives fluid from a sump 52, combines such fluid with the bypass flow used to actuate the flow amplifier 38, and provides the combined fluid to the pump 30. As illustrated, pump 30 has both an inlet 48 for receiving fluid from the flow amplifier 38, and inlet 50 that is connected to the sump 52 through a check valve 54.

Typically, the pump 30 will be capable of supplying flows substantially higher than the maximum flow rate required by the load. In such a situation, the system can have several operating ranges. At low speed, when pump 30 flow is less than the load's maximum flow rate, the flow control valve 34 normally will not be activated and all flow from the pump 30 is directed to the load. As a result, there is no bypass flow and the flow amplifier 38 is not activated. The pump 30 thus pulls all of its flow directly from the sump 52 through the check valve 54.

At mid-range, when pump 30 flow is greater than the load's maximum flow rate but the pump 30 has not reached a speed at which cavitation typically occurs, the flow control valve 34 typically will be activated so that only the required flow is directed to the load. The remainder of the flow is bypass flow that is directed to the flow amplifier 38. The flow amplifier 38 then provides some make-up flow to the pump inlet 48, but the pressure of such flow in the makeup circuit will be minimal since it will match the pressure of the flow from the sump 52 through the check valve 54.

At high speed or range, when the flow amplifier 38 is creating more flow than the pump 30, the flow amplifier 38 will pressurize the pump inlet 48 and the check valve 54 will close thereby preventing the backflow of fluid into the sump 52 via inlet 50 of the pump 30. Thus, the pressure of the fluid supplied to the pump inlet 48 from the flow amplifier 38 can be raised above atmospheric pressure thereby "supercharging" the fluid and consequently increasing the speed at which the pump 30 can be operated without cavitating.

The flow amplifier 38 may be one of a gerotor pump, a vane pump, and axial piston pump and a spur gear pump. When the flow amplifier 38 is a dual port gerotor pump, fluid directed to the flow amplifier 38 from the control valve 34 may drive the gerotor, with the gerotor drawing fluid from the sump 50 and providing fluid the combined fluid flow to the pump 30.

The flow amplifier 38 preferably is of a positive displacement type such as a gerotor or vane pump with a split inlet port, a three or more spur gear system, or a axial piston pump. In an embodiment using a gerotor as the flow amplifier 38, advantage is taken of the fact that the individual pumping chambers are sealed from each other during the full 360 degrees of rotation. This allows the use of split porting for the inlet of the device.

Figure 3:
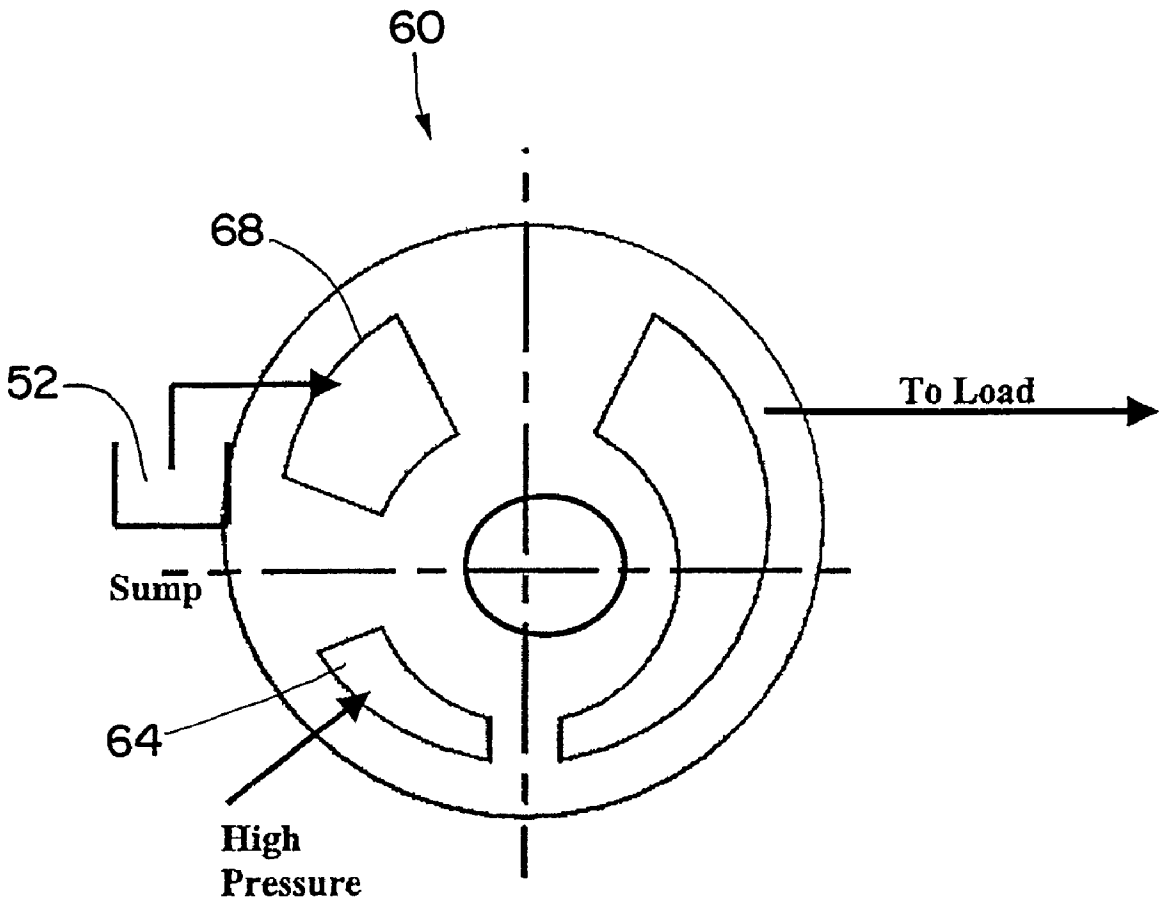
FIG. 3 is a schematic illustration of an exemplary port plate for a gerotor set for use in the hydraulic circuit of FIG. 2.

Turning to FIG. 3, an exemplary port plate 60 illustrates the split porting arrangement. On the left hand side, or intake side, of the port plate 60, two separate inlet ports are shown. The first inlet 64 receives high pressure bypass flow from the control valve 34 for causing the gearset of the gerotor to rotate, while the second inlet 68 is connected to the system sump 52. Accordingly, the high pressure inlet 64 receives fluid for driving the flow amplifier 38, while the second inlet 68 provides make-up flow from the sump 52. Therefore, a given pumping chamber acts as a motor when exposed to the first inlet 64, and as a pump when exposed to the second inlet 68. The output power (pressure times flow for the pump port) will be less than the input power (pressure times flow for the motor port) by an amount of the system losses.

Consequently, one gerotor set can be used instead of two separate gerotor sets, greatly simplifying the system design and reducing the cost. That is, instead using the bypass fluid for driving a gerotor motor that is in turn connected to a gerotor pump, the system described above relies on a single geroter set for performing both the motor and pump duties.

Figure 4:
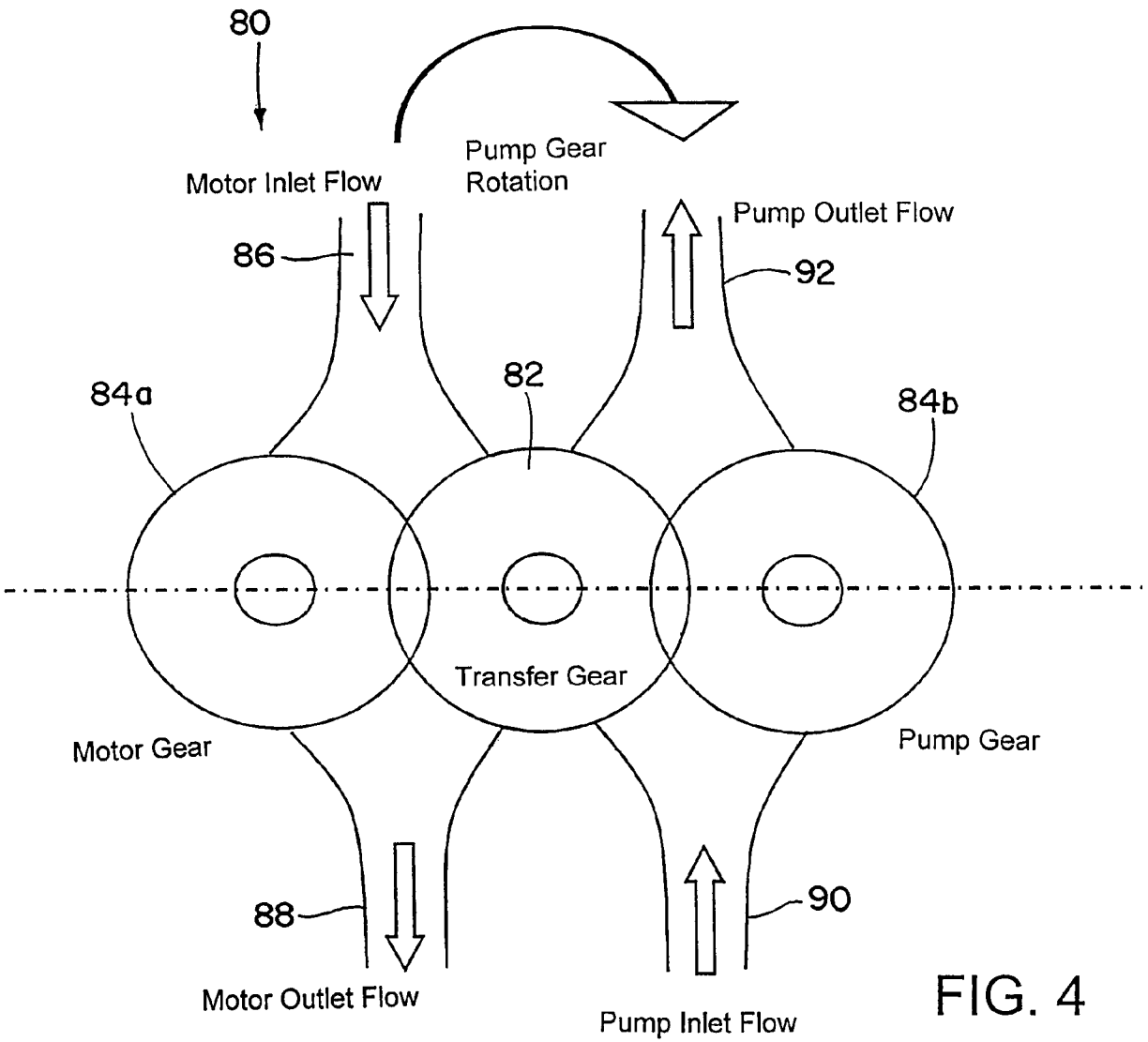
FIG. 4 is a schematic illustration of an exemplary spur gear pump for use in the hydraulic circuit of FIG. 2.

Turning to FIG. 4, another exemplary flow amplifier 38 is illustrated. In FIG. 4, a three gear spur pump/motor assembly 80 includes a drive gear 82, and motor gear 84*a*, and pump gear 84*b*. Transfer gear 82 and motor gear 84*a* together form a motor portion of the assembly where pressurized bypass flow entering inlet 86 and exiting outlet 88 causes rotation of motor gear 84*a* and transfer gear 82. Transfer gear 82 rotates pump gear 84*b* forming a pump portion of the assembly 80 for pumping fluid from inlet 90, which is connected to the sump 52, to outlet 92 when rotating. The outflow of both of outlets 88 and 92 is then supplied to pump 30. While a gerotor, van or axial piston pump version of the flow amplifier may be designed with a wide range of displacements between the motor and the pump portion, the spur gear version is limited to equal displacement of the motor and pump only.

The invention provides one or more advantages including:

1. simpler and lower cost design by eliminating one entire gerotor set,
2. improved overall efficiency by eliminating or at least reducing viscous drag on one full gear set and extra leak paths of an extra gear set, and/or
3. more compact packaging by eliminating one gerotor set.

Thus, it will be appreciated that a system according to the invention provides for recovery of unused pump bypass pressure through a positive displacement fluid flow amplifier. This recovered flow can be used to supercharge the pump inlet to overcome pump cavitation. It may also be possible to reduce energy input with enough inlet pressure increase to the pump.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

The invention claimed is:

1. A system for supplying hydraulic flow to a load, the system comprising:

a pump;

a flow amplifier for, when actuated, supplying fluid to the pump; and a flow control valve for controlling the flow of fluid to the load, fluid not directed to the load being directed to the flow amplifier to actuate the flow amplifier;

wherein the flow control valve has an inlet connected to an outlet of the pump, an outlet for supplying fluid to the load to which hydraulic flow is to be supplied, and a bypass flow outlet connected to the flow amplifier for driving the flow amplifier for supplying fluid to an inlet of the pump.

2. A system as set forth in claim 1, wherein the flow amplifier when actuated receives fluid from a sump, combines the fluid from the sump with fluid used to actuate the flow amplifier, and provides the fluid to the pump.

3. A system as set forth in claim 2, wherein the pump is connected to the sump through a check valve.

4. A system as set forth in claim 1, wherein the flow amplifier is one of a gerotor pump, a vane pump, an axial piston pump and a spur gear pump.

5. A system as set forth in claim 1, wherein the flow amplifier is a dual port gerotor pump, fluid directed to the flow amplifier from the control valve driving the gerotor, the gerotor when driven drawing fluid from a sump and providing fluid to the pump.

6. A system as set forth in claim 4, wherein the flow amplifier when actuated receives fluid from a sump, combines the fluid from the sump with fluid used to actuate the flow amplifier, and provides the fluid to the pump.

7. A system as set forth in claim 1, wherein an inlet of the pump is connected to the sump through a check valve.

8. A system as set forth in claim 1, wherein the flow amplifier is a positive displacement device.

9. A system as set forth in claim 1, wherein the flow amplifier is a dual port gerotor pump configured to be driven by fluid directed to the flow amplifier from the control valve, and when driven drawing fluid from a sump and providing fluid to the pump.

10. A system as set forth in claim 1, wherein the flow amplifier is a vane pump with a split inlet port configured to be driven by fluid directed to the flow amplifier from the control valve, and when driven drawing fluid from a sump and providing fluid to the pump.

11. A system as set forth in claim 2, operable in low, mid and high speed ranges, wherein at low speed, when pump flow is less than the load's maximum flow rate, the flow control valve normally will not be activated and all flow from the pump is directed to the load, whereby there is no bypass flow and the flow amplifier is not activated such that the pump pulls all of its flow directly from the sump, through a check valve;

at mid speed, when pump flow is greater than the load's maximum flow rate but the pump has not reached its cavitation speed yet, the flow control valve is activated so that only the required flow is directed to the load, with the remainder of the flow being bypass flow that is directed to the flow amplifier that then provides some make-up flow to the pump inlet, while the pressure in a makeup circuit will be minimal since it will match the pressure of the flow from the sump through the check valve; and at high speed, when the flow amplifier is creating more flow than the pump, and the flow amplifier starts to pressurize the pump inlet, the check valve on the primary pump line is closed and the pressure on the pump inlet will rise above atmospheric pressure, increasing the speed at which the pump can be operated without cavitating.

12. A method of operating a system for supplying hydraulic flow to a load, the system including a pump, a flow actuator for, when actuated, supplying fluid to the pump, and a control valve for controlling the flow of fluid to the load, fluid not directed to the load being directed to the flow amplifier to actuate the flow amplifier, wherein the flow control valve has an inlet connected to an outlet of the pump, an outlet for supplying fluid to the load to which hydraulic flow is to be supplied, and a bypass flow outlet connected to the flow amplifier for driving the flow amplifier for supplying fluid to an inlet of the pump; the method comprising operating the system in low, mid and high speed ranges, wherein at low speed, when pump flow is less than the load's maximum flow rate, the flow control valve normally will not be activated and all flow from the pump is directed to the load, whereby there is no bypass flow and the flow amplifier is not activated such that the pump pulls all of its flow directly from the sump, through a check valve;

at mid speed, when pump flow is greater than the load's maximum flow rate but the pump has not reached its cavitation speed yet, the flow control valve is activated so that only the required flow is directed to the load, with the remainder of the flow being bypass flow that is directed to the flow amplifier that then provides some make-up flow to the pump inlet, while the pressure in a makeup circuit will be minimal since it will match the pressure of the flow from the sump through the check valve; and at high speed, when the flow amplifier is creating more flow than the pump, and the flow amplifier starts to pressurize the pump inlet, the check valve on the primary pump line is closed and the pressure on the pump inlet will rise above atmospheric pressure, increasing the speed at which the pump can be operated without cavitating.

* * * * *